US005189874A

United States Patent [19]

Kreitmeier

[11] Patent Number: 5,189,874

[45] Date of Patent: Mar. 2, 1993

[54] AXIAL-FLOW GAS TURBINE COOLING ARRANGEMENT

[75] Inventor: Franz Kreitmeier, Baden, Switzerland

[73] Assignee: Asea Brown Boveri Ltd., Baden, Switzerland

[21] Appl. No.: 679,274

[22] Filed: Apr. 2, 1991

[51] Int. Cl.[5] ..... F02C 3/00; F01D 5/14

[52] U.S. Cl. ..... 60/39.75; 415/115; 415/175; 415/176

[58] Field of Search ..... 60/39.75; 415/115, 116, 415/117, 175, 176

[56] References Cited

U.S. PATENT DOCUMENTS

| | | | |
|---|---|---|---|
| 2,647,684 | 8/1953 | Lombard | 60/39.75 |
| 2,951,337 | 9/1960 | Atkinson et al. | 60/39.75 |
| 3,826,084 | 7/1974 | Branstrom et al. | 60/39.66 |
| 3,989,410 | 11/1976 | Ferrari | 415/115 |
| 4,236,869 | 12/1980 | Laurello | 416/95 |
| 4,332,133 | 6/1982 | Schwarz et al. | 60/39.75 |
| 4,462,204 | 7/1984 | Hull | 415/115 |
| 4,650,395 | 3/1987 | Weidner | 415/115 |
| 4,657,482 | 4/1987 | Neal | 415/176 |

FOREIGN PATENT DOCUMENTS

| | | |
|---|---|---|
| 0188910 | 7/1986 | European Pat. Off. . |
| 0313826 | 5/1989 | European Pat. Off. . |
| 2003947 | 7/1970 | Fed. Rep. of Germany . |
| 3424139 | 1/1986 | Fed. Rep. of Germany . |
| 2100360 | 12/1982 | United Kingdom . |
| 2189845 | 11/1987 | United Kingdom . |

*Primary Examiner*—John J. Vrablik
*Assistant Examiner*—Howard R. Richman
*Attorney, Agent, or Firm*—Oblon, Spivak, McClelland, Maier & Neustadt

[57] ABSTRACT

In a single-shaft axial-flow gas turbine, the shaft part lying between turbine and compressor is a drum (12) which is surrounded by a drum cover (13). The annular passage (18) formed between drum and drum cover assumes the function of conducting all the rotor cooling air, tapped on the hub side behind the last moving row of the compressor, to the front end (16) of the turbine and after this to its rotor-side cooling passages. The cooling air is deflected inside the annular passage in a spin cascade (25) and accelerated to the highest possible tangential velocity. With this measure, the axial thrust of the gas turbine can be reduced on the one hand and the hitherto conventional recooler for the cooling air can be dispensed with on the other hand.

4 Claims, 2 Drawing Sheets

AXIAL-FLOW GAS TURBINE COOLING ARRANGEMENT

BACKGROUND OF THE INVENTION

1. Field of the invention

The invention relates to an axial-flow gas turbine, essentially consisting of a multistage turbine which drives, inter alia, a compressor arranged on a common shaft, in which the shaft part lying between turbine and compressor is a drum which is surrounded by a drum cover, and in which the annular passage formed between drum and drum cover assumes the function of conducting the cooling air tapped from the compressor to the front end of the turbine rotor and after this to its rotor-side cooling passages, and for which a labyrinth seal sealing against the drum cover is arranged on the drum for sealing between the pressure levels at the outlet of the compressor and at the inlet of the cooling air into the turbine, all the rotor-side cooling air for the turbine being tapped from the compressor in the area of the compressor outlet.

2. Discussion of Background

Gas turbines of this type are known. All the rotor-side cooling air is tapped from the collecting space between compressor and turbine; most of it flows directly via an accelerating cascade into the rotor cooling passages. Here, the accelerating cascade is as a rule located on the same radius as the rotor cooling passages at the front end of the turbine rotor. The smaller portion of cooling air, i.e. the air necessary for cooling the last compressor disk as well as the drum and first turbine disk, must be recooled in a cooler for exercising the cooling function before it can be passed free of spin into the annular passage. This solution results in a number of shortcomings.

Firstly, the cooling air, since it is tapped from the collecting space, does not have the highest possible and desired purity as demanded, in particular, by the fine cooling passages of the blades.

Secondly, a separate, costly apparatus is required for the recooling.

Furthermore, this smaller, recooled portion of air, as a result of the convective heating-up, is in turn considerably heated up on its way up to the inlet into the annular passage, as a result of which the cooling effect is reduced.

In addition, the feeding of the air free of spin causes an additional increase in the adiabatic wall temperature in the relevant areas.

Finally, the feeding of the cooling air free of spin into the annular passage also produces a high heat transfer coefficient $\alpha$ in the entire rotor area to which the cooling air is admitted, which, together with the increased cooling-air temperature mentioned, can cause high transient stresses.

In addition, extremely high $\alpha$-coefficients with the known disadvantages result in the area of the drum labyrinth.

In these known gas turbines, a return flow, i.e. an inflow of recooled air from the annular passage into the main passage of the compressor behind its last moving row is deliberately accepted. It goes without saying that this measure results in a not inconsiderable disturbance of the main flow.

Owing to the fact that the inflow into the rotor cooling passages inevitably takes place with little spin, the rotor has to perform pump work, which further increases the cooling-air temperature.

SUMMARY OF THE INVENTION

The invention attempts to avoid all these disadvantages. Furthermore, the additional object of the invention is to reduce the axial thrust in axial-flow gas turbines of the type mentioned at the beginning, which have amply dimensioned rotor front ends on the turbine side.

According to the invention this is achieved when the rotor-side cooling air for the turbine is tapped after the last moving row of the compressor at its hub and is passed in the spinning state directly into the annular passage, and when this cooling air is deflected inside the annular passage in a spin cascade and accelerated to the highest possible tangential velocity.

The advantages of the invention can be seen, inter alia, in the omission of the hitherto conventional, expensive cooler on the one hand and the low transient stresses in the shaft area around which the air flows on the other hand.

It is particularly convenient when the rotor-side cooling air is tapped after the last moving row of the compressor at its hub and is passed in the spinning state into the annular passage. This ensures on the one hand that the heating-up of the rotor via the cooling air and thus the level of the transient stresses is as small as possible. In addition, the purest possible, virtually dust-free air is passed into the annular passage by tapping on the hub side.

Furthermore, it is advantageous when the spin cascade in the annular passage is arranged on a smallest possible radius and as far as possible in direct proximity to the wheel side space. Here, the smallest possible radius is orientated to the speed of sound present at this location. A means of reducing the axial thrust is therefore available.

Finally, the labyrinth seal sealing against the drum cover is advantageously subdivided on the rotor side into segments in order to reduce the heat transfer coefficient $\alpha$. The effect of the $\alpha$-values, normally extremely high in labyrinths, is thereby prevented.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an exemplary embodiment of the invention is shown with reference to a single-shaft axial-flow gas turbine. In the drawings.

Only the elements essential for understanding the invention are shown. Of the plant, for example, neither the exhaust housing of the gas turbine with exhaust pipe and chimney nor the inlet portions of the compressor part are shown. The flow direction of the working media is designated by arrows.

DESCRIPTION OF THE PREFERRED EMBODIMENTS

Figure 1:
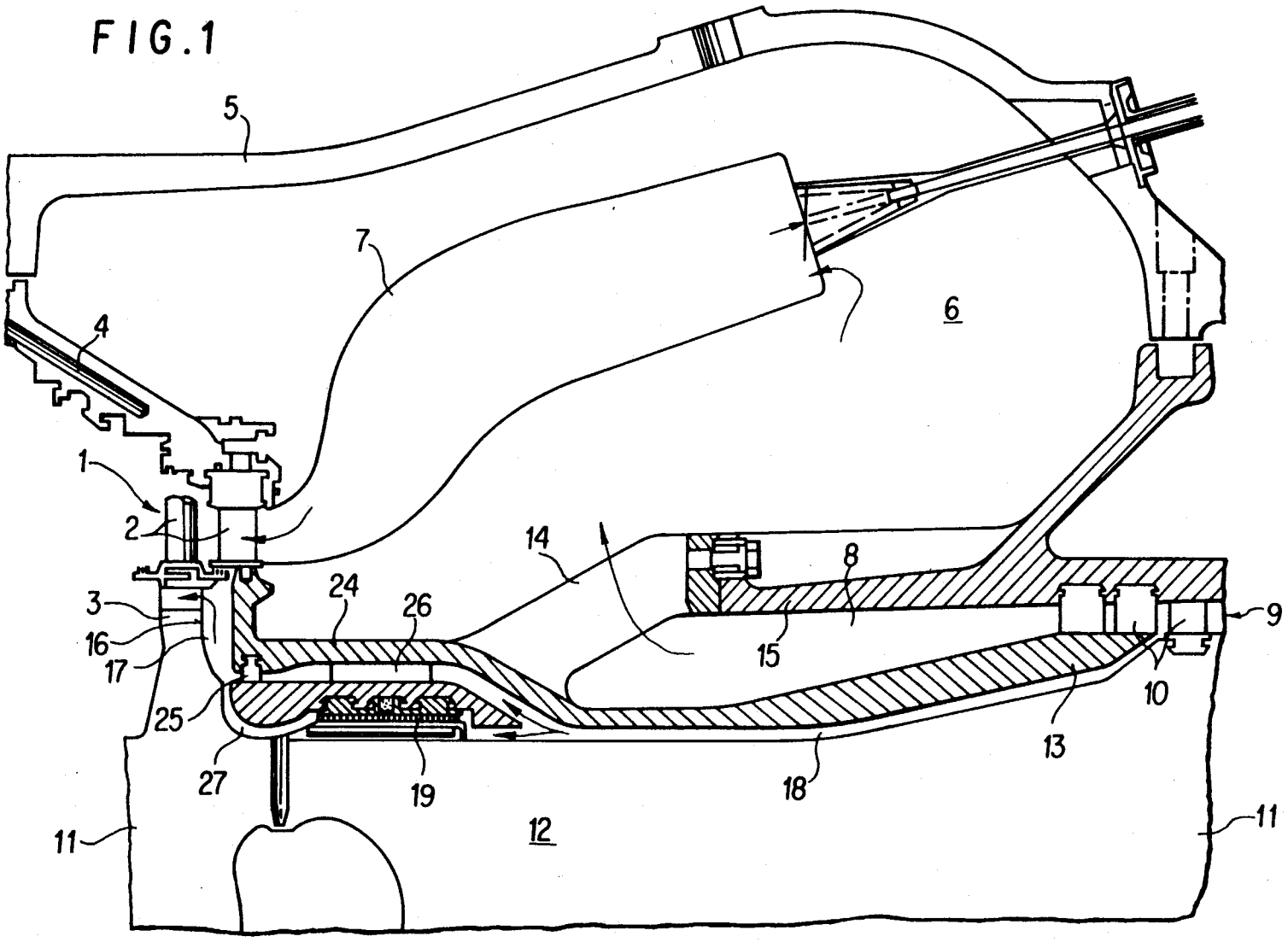
FIG. 1 shows a partial longitudinal section of the gas turbine.

Referring now to the drawings, wherein like reference numerals designate identical or corresponding parts throughout the several views, the turbine 1, of which only the first axial-flow stage 2 in the form of a guide row and a moving row is shown in FIG. 1, essentially consists of the bladed rotor 3 and the blade carrier 4 equipped with guide blades. The blade carrier is suspended in the turbine casing 5. In the case shown, the turbine casing 5 likewise comprises the collecting space 6 for the compressed combustion air. The combustion air passes from this collecting space into the annular combustion chamber 7, which in turn leads into the turbine inlet, i.e. upstream of the first guide row. The compressed air from the diffuser 8 of the compressor 9 passes into the collecting space. Only the last stage 10 of the compressor 9 is shown, the guide blading of this last stage consisting of the actual guide row and the secondary guide row. The moving blading of the compressor and the turbine sits on a common shaft 11, the part located between turbine and compressor being designed as a drum 12. Over its entire axial extent, this drum is surrounded by a drum cover 13 which is fastened via ribs 14 to the outer diffuser casing 15 of the compressor. On the compressor side, this drum cover forms the shroud band for the blades of the last two compressor guide rows. On the turbine side, the drum cover together with the front end 16 of the turbine rotor defines a radially running wheel side space 17.

This space 17 forms the discharge-side end of an annular passage 18 which, starting from the hub behind the last moving row of the compressor, runs between drum cover and drum. All the rotor-side cooling air is passed into this annular passage. When dimensioning the annular passage 18, the following should be taken into consideration on account of the flow in the spinning state prevailing therein: so that the spinning flow along the drum does not become unstable, normal and tangential velocity of the cooling air as well as average radius and height of the passage must be in a certain relationship to one another, as is known from the theory of spinning flow.

Figure 3:
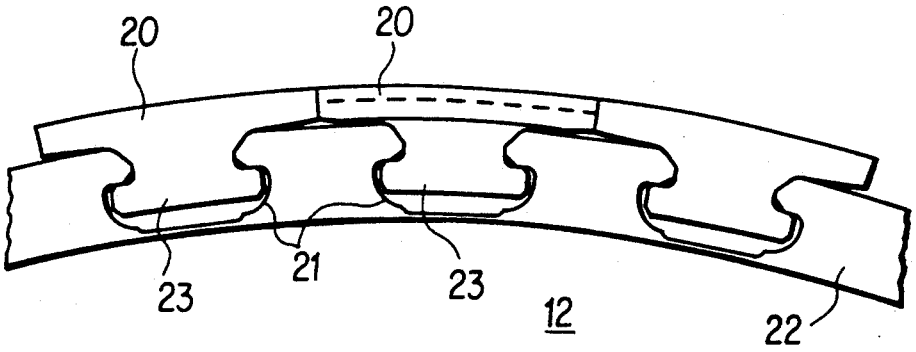
FIG. 3 shows a partial cross-section through the drum in the plane of the labyrinth.

At the turbine-side end, a labyrinth 19 sealing against the drum cover is arranged on the drum. However, the labyrinth only seals indirectly against the drum cover. Its non-rotating part is fastened in a labyrinth body 24 in a suitable manner. To lower the heat transfer coefficient $\alpha$, the labyrinth is subdivided on the rotor side into a number of segments arranged on the drum surface. The segmenting of the labyrinth 19 is shown in FIG. 3. In the example shown, this comprises axially directed hammer-head grooves 21 which are made in a collar 22 of the drum 12. So-called heat-accumulation segments 20 having feet 23 of appropriate configuration are hooked into these grooves. Metallic sealing strips (not shown in FIG. 3) act against the outer surfaces, projecting into the annular passage, of the heat-accumulation segments, which sealing strips can, for example, be caulked in the labyrinth body 24 or fastened in another manner.

According to the invention, the cooling air is now to be deflected inside the annular passage 18 in a spin cascade and accelerated to the highest possible tangential velocity. This spin cascade 25 is provided in the annular passage in the form of spin nozzles directly opposite the front end 16 of the turbine rotor, i.e. it leads directly into the wheel side space 17. For reasons to be explained later, it is convenient to arrange the spin cascade on the smallest possible radius.

To hold the labyrinth body 24 in its position, it is connected to the drum cover 13 via a plurality of flow-orientated supporting ribs 26 distributed at the periphery.

Figure 2:
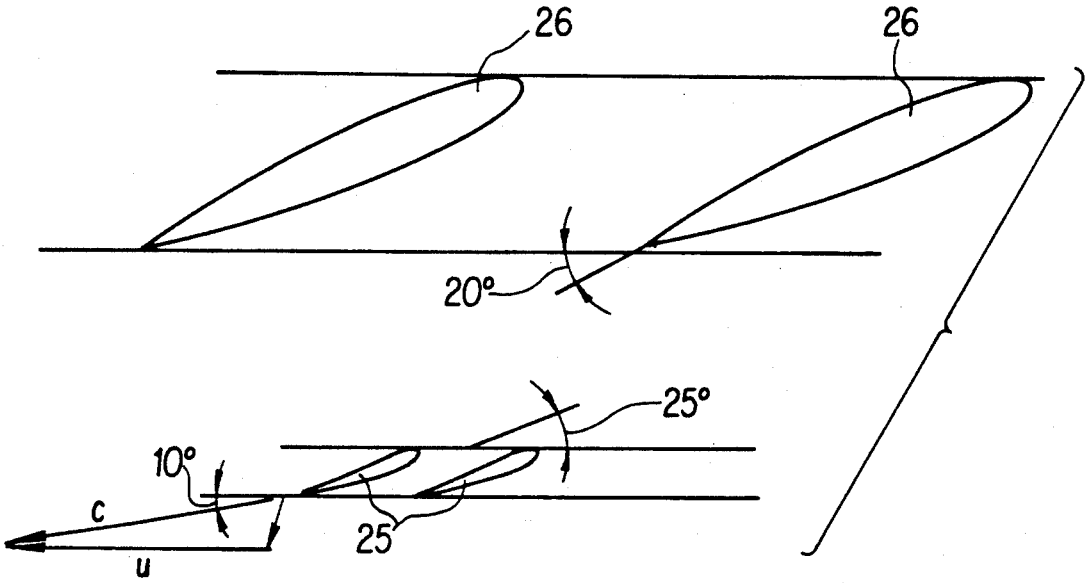
FIG. 2 shows the partial development of a cylinder section on the average diameter of the annular passage through which air flows.

The cylinder section in FIG. 2 shows on an enlarged scale the blade plan above the labyrinth body 24. In this blade plan, c denotes the absolute velocity of the cooling air and u the peripheral velocity of the rotor. For the purpose of indicating the order of magnitude in an exemplary embodiment, the ratio of pitch to chord in the case of the supporting ribs 26 is, for example, 1.2 and in the case of the spin nozzles 25 it is about 0.85. The supporting ribs 26 are merely flow ribs having a symmetrical profile in which neither a change in the velocity nor the direction is imposed on the flow. The flow leaves the supporting ribs at the velocity c and an angle of about 20° to the peripheral direction.

The spin nozzles are an accelerating cascade having slight curvature of the mean camber line, which accelerating cascade deflects the flow from, at this point, about 25° to about 10° and increases the velocity from about 120 to about 420 m/sec.

The mode of operation of the invention will be explained below with reference to a numerical example: it goes without saying that all absolute values underlying the calculations and tests will not be disclosed, since these absolute values would in any case have little informative value on account of their dependency on far too many parameters.

All the cooling air required for cooling the rotor, i.e. about 8% of the compressed air, is tapped behind the last moving row in the area of the hub. The cooling air in the spinning state flows through the annular passage 18 up to in front of the drum labyrinth 19. The spinning predetermined from the compressor ensures that, as a result of the low relative velocity between rotor surface and cooling air, minimum heat transfer coefficients and lowest possible adiabatic wall temperatures are achieved. This in turn results in low transient stresses and lowest possible steady-state temperatures in the area considered.

Merely the unavoidable leakage quantity flows through the labyrinth 19. A reduction in the tangential velocity in the labyrinth to about 50% of the peripheral velocity there cannot be avoided. Thus part of the abovementioned positive spinning effect is already lost. In addition, the $\alpha$-value is increased by the specific configuration of the flow in the labyrinth. A corrective measure is taken here by the segmenting of the rotor-side labyrinth part, which segmenting greatly reduces the heat flow into the drum. Due to the fact of the reduction in spinning inside the labyrinth, it is important for the part of the outflow passage 27 following the labyrinth to be dimensioned so as to be as short as possible, i.e. the labyrinth is to be laid as close as possible to the first turbine disk.

The main portion of the rotor cooling air is conducted via the flow-orientated supporting ribs 26 of the labyrinth body 24 into the spin nozzles 25. The cooling air is accelerated in the latter almost to the speed of sound while simultaneously being deflected slightly in the direction of rotation of the rotor. In the process, the cooling air flows off from the spin cascade virtually tangentially, i.e. about 10° to the peripheral direction.

On the other hand, this intense spinning has in turn a positive effect on the heat transfer, as already described above. Advantageous values can be obtained if the ratio of tangential velocity to peripheral velocity is about 1 at the inlet of the cooling air into the rotor. This means that no exchange of work takes place when the cooling air flows into the rotor cooling passage, i.e. work is neither removed from nor added to the rotor. In particular, the temperature of the cooling air is also not increased by pump work.

Furthermore, the static pressure at the outlet from the spin cascade is greatly reduced by the high velocity level. Thus a lower average pressure prevails in the wheel side space, as a result of which the axial thrust of the rotor is reduced.

The invention is of course not restricted to the exemplary embodiment shown and described. In a deviation from the solution of the separate supporting ribs and spin nozzles, a design is perfectly conceivable in which these two elements are combined in a single cascade.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An axial flow gas turbine, comprising:

a compressor section having at least one row of rotating blades for creating a spinning flow of compressed air having a tangential flow velocity component;

a turbine section having at least one row of rotating blades;

a rotating drum connected between said compressor section with said turbine section;

a drum cover surrounding said drum between said compressor section and said turbine section, said drum cover and drum defining an annular passage having an inlet adjacent a downstream most one of the compressor blades for permitting the spinning flow of compressed air to flow through the annular passage;

a spin cascade positioned adjacent a radially innermost portion of a downstream end of said annular passage for tangentially accelerating the spinning flow and directing the spinning flow towards the blades of the turbine section for cooling the blades of the turbine sections; and a labyrinth seal in the downstream end of said annular passage and positioned in parallel flow with said spin cascade, wherein said annular passage comprises means for permitting the spinning flow from said compressor section to reach said spin cascade without impediment to the tangential component of the spin flow velocity.

2. The turbine of claim 1, wherein said labyrinth seal comprises the only seal in said annular passage.

3. The turbine of claim 1, wherein the downstream end of said annular passage comprises a wheel said space defined between said drum cover and a rotor of said turbine section.

4. The turbine of claim 1, wherein said labyrinth seal comprises a plurality of segments.

* * * * *